US006042429A

United States Patent [19]

Bianca et al.

[11] Patent Number: 6,042,429

[45] Date of Patent: Mar. 28, 2000

[54] CONTINUOUS PRESS-FIT KNURL PIN

[75] Inventors: Giuseppe Bianca, Temecula; Robert M. Bogursky, Encinitas, both of Calif.

[73] Assignee: Autosplice Systems Inc., San Diego, Calif.

[21] Appl. No.: 08/912,602

[22] Filed: Aug. 18, 1997

[51] Int. Cl.[7] ..... H01R 13/40

[52] U.S. Cl. ..... 439/733.1; 439/78

[58] Field of Search ..... 439/733.1, 78, 439/83, 84

[56] References Cited

U.S. PATENT DOCUMENTS

| | | | |
|---|---|---|---|
| 1,488,948 | 4/1924 | Smith | 439/87 |
| 3,670,294 | 6/1972 | Johnson et al. | 439/733.1 |
| 4,318,964 | 3/1982 | Zahn et al. | 428/572 |
| 4,469,394 | 9/1984 | Verhoeven | 439/733.1 |
| 4,698,026 | 10/1987 | Rolf | 439/751 |
| 4,832,622 | 5/1989 | Zahn | 439/590 |
| 5,035,656 | 7/1991 | Patel | 439/733.1 |
| 5,318,452 | 6/1994 | Brennian, Jr. et al. | 439/79 |
| 5,897,401 | 4/1999 | Fili et al. | 439/733.1 |

OTHER PUBLICATIONS

Paper By Irwin Zahn entitled "Six (6) Easy Enhancements Of Continuous Pin And Post Terminals", which was presented at the Connector And Interconnection Technology Symposium on Oct. 15–18, 1989 in Philadelphia, PA, and which was published in its 1989 Annual Proceedings.

*Primary Examiner*—Michael L. Gellner
*Assistant Examiner*—Briggitte R. Hammond

[57] ABSTRACT

A novel press-fit pin or socket member, as, for example, an electrically-conductive metal pin, characterized by a knurl section which has spaced bumps and adjacent grooves perimetrically and longitudinally spaced from one another and which is adapted to engage a substrate hole in a press-fitting relationship. Pin or socket members with the knurl section can be manufactured by a wire-forming process in which end-to-end connected pins are formed as a continuous strip needing no excess material for carrying the pins, nor are any air gaps formed between the pins, and thus the finished continuous strip of pins can be wound up on a reel.

12 Claims, 4 Drawing Sheets

CONTINUOUS PRESS-FIT KNURL PIN

The invention is directed to a solid press-fit pin for press-fitting into preformed holes in a substrate, such as a printed circuit board (PCB) or header or the like.

BACKGROUND OF INVENTION

Several types of press-fit techniques for mounting electrically-conductive contact members such as pins into the preformed typically plated-through or blind holes in a PCB are known. In the most common type, a solid pin is used, which has no spring energy. The solid pin is press-fitted into the non-elastically-deformable area of a plated-through or blind hole, and relies on an enlarged pin section, the so-called star, whose widest dimension (across a diagonal) exceeds the inside diameter of the hole typically by about 0.004 inches. For example, for a solid pin with a nominal diameter of 0.025 inches, the hole size would be 0.029 inches ±0.002 inches and the star diameter would be 0.033 inches. In addition to its use in PCBs, as board to board or cable to board interconnects, as jumper shunt posts, as test posts, or as wire-wrap posts, such pins are also widely used in pin headers in which the header substrate is elastically-deformable. It is common to manufacture such pins as parts of a continuous strip wound upon a reel for use in automatic insertion machines. Reference is made to U.S. Pat. No. 4,318,964, which describes one way of making such pin strips and using such strips in automatic insertion machines, and U.S. Pat. No. 4,832,622, which describes one way of making pin headers using such pins, whose contents are herein incorporated by reference.

U.S. Pat. No. 4,3187,964 describes the configuration of contact pins, their assembly into a strip that can be reeled up, and a machine using the reel of pins for separating a pin from the strip and inserting it into a substrate such as a printed circuit board (PCB). That patent also describes a so-called star configuration in which a region along the length of the pin is enlarged to enhance its holding power in the substrate, commonly defined as the pull-off strength, i.e., the amount of force in grams needed to pull the pin out from the substrate.

Reference is also made to a paper by Irwin Zahn entitled "Six (6) Easy Enhancements Of Continuous Pin And Post Terminals", which was presented at the Connector And Interconnection Technology Symposium on Oct. 15–18, 1989 in Philadelphia, Pa., and which was published in its 1989 Annual Proceedings, whose contents also are herein incorporated by reference, which provides more detailed descriptions of the fabrication of such pins and various ways of using them, including the use of known pin systems with high speed pin insertion machines from reeled strips of the pins. The common methods for forming such pin strips is by coining, a cold-working process which upsets the material to form the enlarged diameter section.

The known pin configurations exhibit several deficiencies, including: providing the enlarged diameter section offers less retention than desired, increasing the widest dimension to improve retention often results in a loss of pin strength, provision of the enlarged diameter section often results in undesired axial enlargement of the pin, and the known enlarged diameter section manufacture cannot be applied to a continuous pin strip or used to make pins with non-round cross-sections or used to make miniature-sized pins.

SUMMARY OF INVENTION

A principal object of the invention is a novel press-fit (hereinafter defined) electrically-conductive pin member that can be reliably mounted in substrates.

Another object of the invention is a novel male press-fit electrically-conductive pin member that is less expensive to manufacture and is less costly to package.

Still another object of the invention is a new scrapless method for fabricating male press-fit electrically-conductive pin members with various cross-sections.

A further object of the invention is a novel male press-fit electrically-conductive pin member that exhibits greater retention when header mounted without sacrificing pin strength and while undergoing minimal axial growth.

These and other objects are achieved in accordance with one feature of the invention by a novel press-fit electrically-conductive pin member, characterized by a series of bumps and grooves, what we term herein a "knurl section", which replaces the star section of the prior art solid press-fit pins.

In accordance with another feature of the invention, the pin is manufactured as a continuous strip with spaced continuously-formed knurl sections in a scrapless method free of carrier strips or secondary packaging.

In accordance with a further feature of the invention, the knurl section comprises perimetrically and longitudinally spaced sets of bumps and grooves with adjacent sets oriented 90 degrees with respect to one another. "Perimetrically" is used in its broadest sense to mean the outer boundary of a body or figure.

In accordance with a preferred embodiment of the invention, the pins with the knurl section are manufactured connected end-to-end by a wire-forming process needing no excess material for carrying the pins. Nor are spaces required between adjacent pins, and thus the finished product can be wound up on a reel lowering fabrication and packaging costs as well as shipping and handling expenses.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF PREFERRED EMBODIMENTS

The contact pin of the invention can be fabricated with different cross-sections, such as round, square or rectangular.

FIGS. 1, 5, 7, and 7A illustrate one form of round pin member comprising a knurl section in accordance with the invention. The most important application of the invention is the fabrication of metal pins for insertion by automatic insertion machines into of a PCB or pin header. However, the invention is not limited to metal pins, nor to PCBs or headers. The invention can be used with any kind of substrate that has openings into which a projecting member needs to be mounted by insertion in the holes. While a common purpose would be to establish an electrically-conductive contact between an electrically-conductive portion on the contact member and an electrically-conductive part on the substrate, the latter need not be on the walls of the hole but could be a pad or other electrically-conductive member on a surface of the substrate. The invention can also be applied to projecting members from sockets that can use the knurl section of the invention for mounting of the socket on a substrate. However, to simplify the description, with the understanding that the invention is not so limited, the invention will be described and illustrated in the most common application employing in this case, as a contact member, a male pin 10, intended to receive a female connector (not shown) for establishing an electrical connection between a wire or component connected to the female connector and a component on a PCB and connected via a conductive trace to the pin 10.

Figure 7:
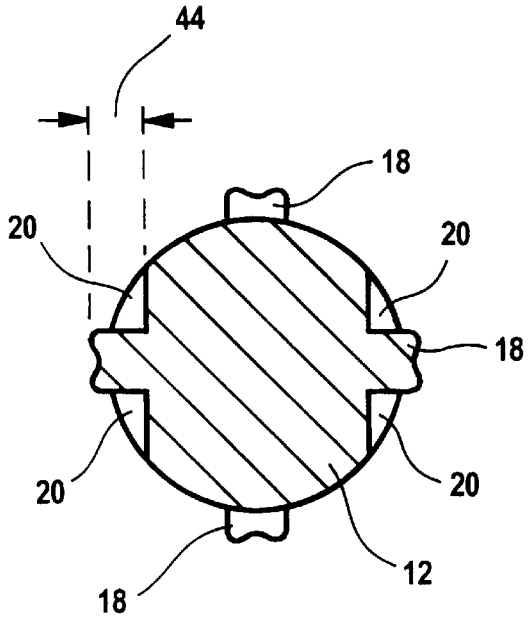
FIG. 7 is a cross-sectional view of the knurl section of the FIG. 1 pin.
Figure 7A:
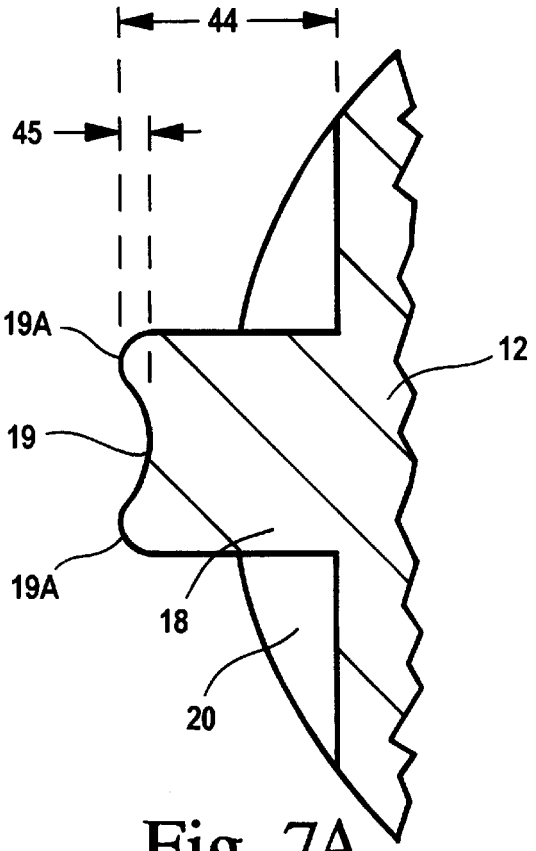
FIG. 7A is an enlarged cross-sectional view of a bump on a knurl section.

In the embodiment illustrated in FIGS. 1, 5, 7 and 7A, the male pin 10 comprises an elongated cylindrical metal body 12 of uniform cross-section having a longitudinal axis and having beveled ends 14 and an enlarged knurl section 16 positioned above the bottom end about ⅓ the distance of the pin length. The knurl section 16 comprises a series of perimetrically and longitudinally spaced bumps 18 and adjacent grooves 20 forming plural sets of bumps and adjacent grooves, formed from the surface pin material, with the diagonal or widest pin dimension across the bumps forming the press-fit dimension that exceeds the hole internal diameter. The sets of bumps 18 and grooves 20 form a pattern similar to a standard knurl, except that, instead of being roll formed from the pin material as is done to make a knurl, a pair of punch and dies 22 (FIG. 8) skive from opposite sides a portion of the surface of the pin, which creates a raised bump 18 of material between the dies, and a groove or crater 20 behind each of the dies (the dies 22 never come completely together). The top or outer surface of each bump 18 can be flat, slightly convex, or slightly convave as shown in FIG. 7. We prefer however the configuration illustrated more clearly in FIG. 7A, wherein each bump 18 has at least one raised region, and preferably a concave center 19 flanked by two raised regions 19A. This structure increases retentivity in the substrate by its increased irregularity which results in increased frictional forces when a pulling force is applied to the mounted pin.

Figure 8:
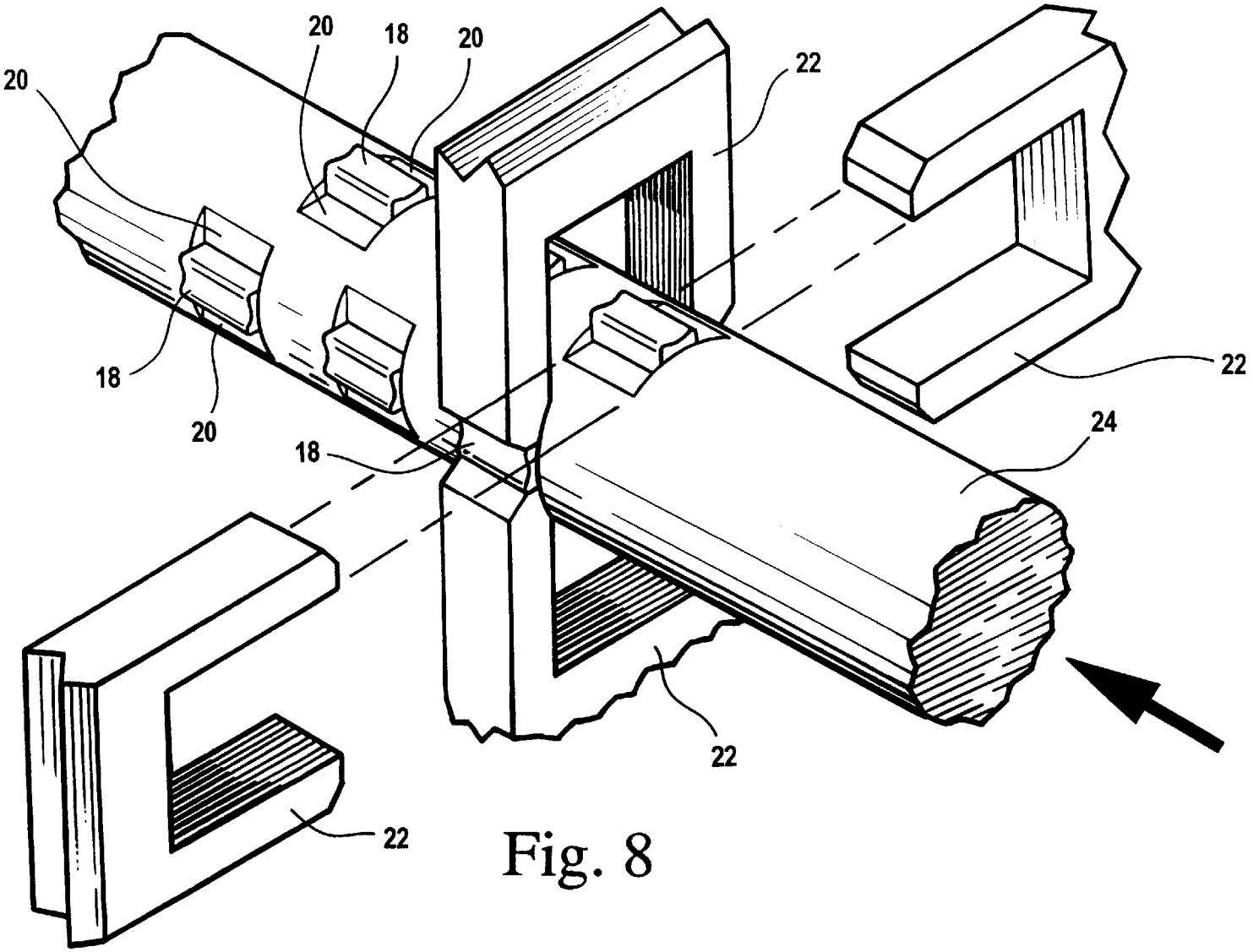
FIG. 8 is a schematic view illustrating one form of fabrication method of the pin member of FIG. 1.

FIG. 8 illustrates top and bottom punch and dies skiving out a crater 20 on opposite sides of a bump 18 on the side of the body of pin stock 24. A pair of punch and dies are also present on the right and left sides of the metal body ready to form or just having formed bumps and grooves on the top and bottom sides of the pin body. These bumps and grooves are perimetrically and longitudinally offset from each other creating sets of bumps 18 and grooves 20 at a desired distance or in a desired pattern which will allow malleable substrate material (preferably plastic) of for example a header, inside the press-fit hole, which has been displaced by a bump on the inserted pin, to flow into the groove area therefore minimizing the stress in the press-fit hole, while creating a higher retention force on the pin. As will be observed from FIG. 8, when the pin stock 24 is situated at a particular point in their forward movement, the top and bottom dies are actuated to form the bumps and grooves at the left and right sides (designated 26 in FIG. 1) of the pin. The pin stock 24 can then be advanced a short distance whereupon the left and right dies are actuated to form the bumps and grooves at the top and bottom sides (designated 28 in FIG. 1) of the pin, and so on. The dies 22 thus alternate in operation until the knurl section 16 is completed; then the pin stock is advanced the appropriate length and other dies (not shown) form a conventional notch 30 which ultimately provides the bevelled ends 14 when the pin is separated from a strip 32 of the pins (FIG. 2).

The bump height (referenced 44) is controlled by the distance the die penetrates the surface of the pin, as well as the amount of distance the die travels across the surface (i.e., as the die plows material, the material builds up in front of the die). The die arrangement can be adjusted so that the dies stop when the appropriate bump height is reached. The bump and groove length (the dimension parallel to the longitudinal dimension of the pin) is controlled by the die length. In the example shown in FIG. 5, six circumferential rows of sets of bumps and grooves are formed, three on top and bottom and three on the left and right sides of the pin. The desired number of rows can be achieved by stacking a series of die sets together to form the pattern of bumps and grooves, each set of dies forming a row oriented 90 degrees with respect to the previous and following die set. Preferably, the height of the flanking raised regions 19A (45 in FIG. 7A) is approximately 5–50% of the height 44 of the bump 18.

Each perimetrical row of bumps and grooves is longitudinally spaced from the adjacent perimetrical row, by an axial distance preferably at least 0.002 inches. This has the advantage of maintaining the pin strength, since the cross-section is not reduced in this area. An advantage of the laterally-directed skiving scheme is that minimal axial pin growth occurs, which is important where the pin length tolerences are small. Also, the laterally-directed skiving scheme minimizes punch depth for a given widest bump dimension also contributing greater pin strength. The latter is especially important for miniature pins, having nominal pin diameters of 0.045 inches or less in both the square and round configurations.

Figure 1:
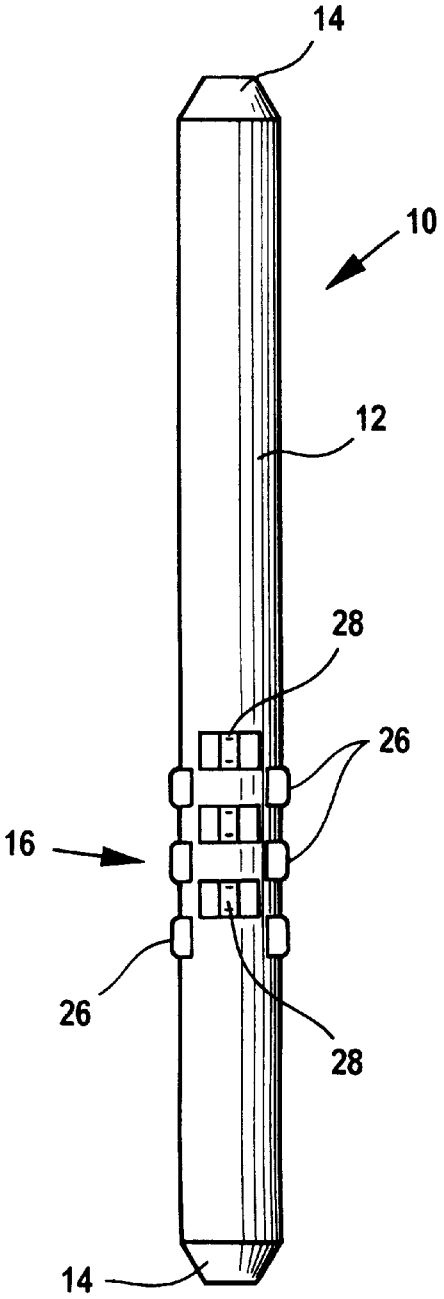
FIG. 1 is a front elevational view of one form of round pin member comprising a knurl section in accordance with the invention.
Figure 2:
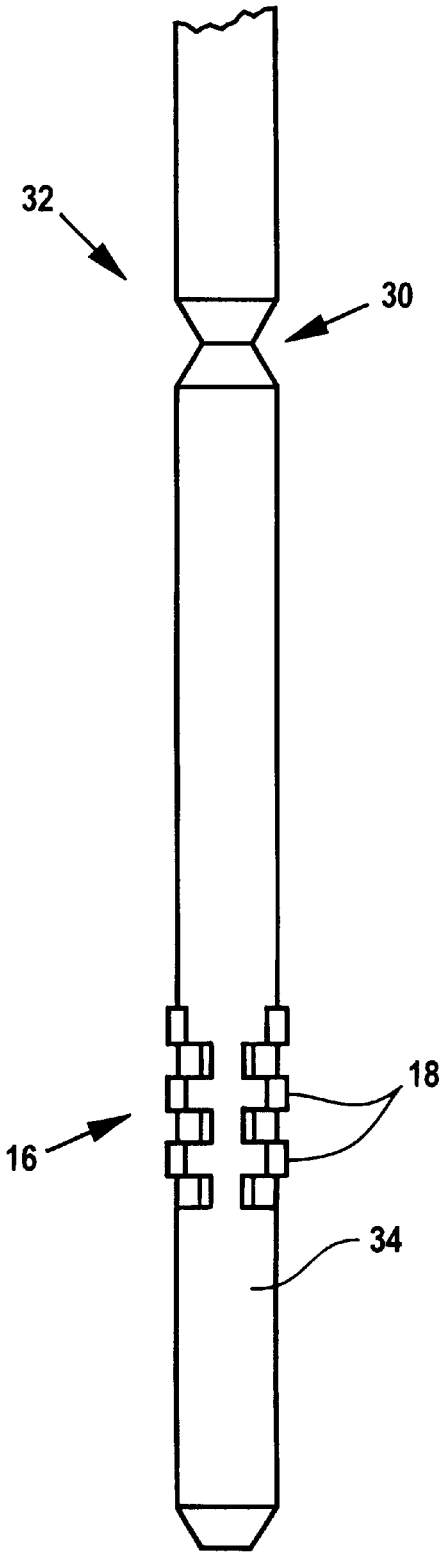
FIG. 2 is an elevational view showing how a strip of square pins according to the invention would be formed.
Figure 3:
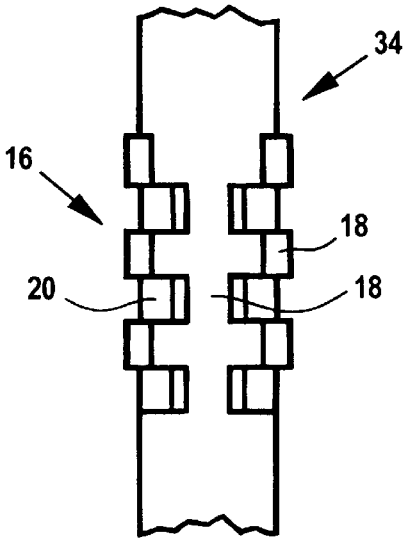
FIG. 3 is an enlarged view of the knurl section of the pin of FIG. 2.
Figure 6:
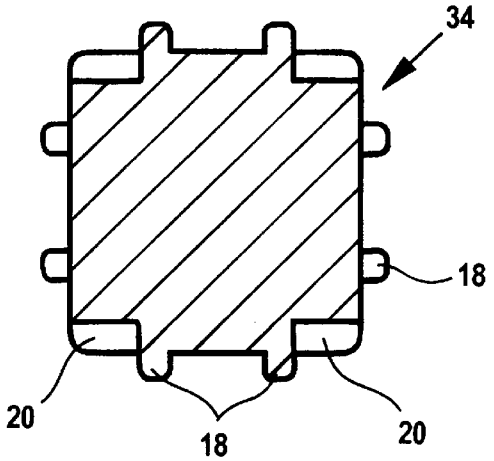
FIG. 6 is a cross-sectional view of the knurl section of the FIG. 2 pin.

FIGS. 2, 3 and 6 show another form of pin 34 in accordance with the invention having a square cross-section. The knurl section 16 is made the same way as the knurl section of the round pin of FIG. 1.

Since the interference area of the pin (i.e., the pin section that forms the interference or press-fit with the hole, corresponding to the bump height) is raised from the surface of the pin, insertion friction is reduced and product reliability improved by reducing abrasion of the typical pin plating or hole damage during insertion of the pin. As will be seen from the typical dimensions given above, the pin body is slightly smaller than the hole diameter so the clearance prevents undue abrasion of any solder-promoting surface plating of the pin, such as lead-tin or nickel, and the press-fit arises from the enlarged diameter of the knurl section 16. As the preceding length of the pin which is passed through the hole is less than or at most equal to the hole size, this protects the pin from being damaged due to scraping off of the plating during assembly.

Figure 4:
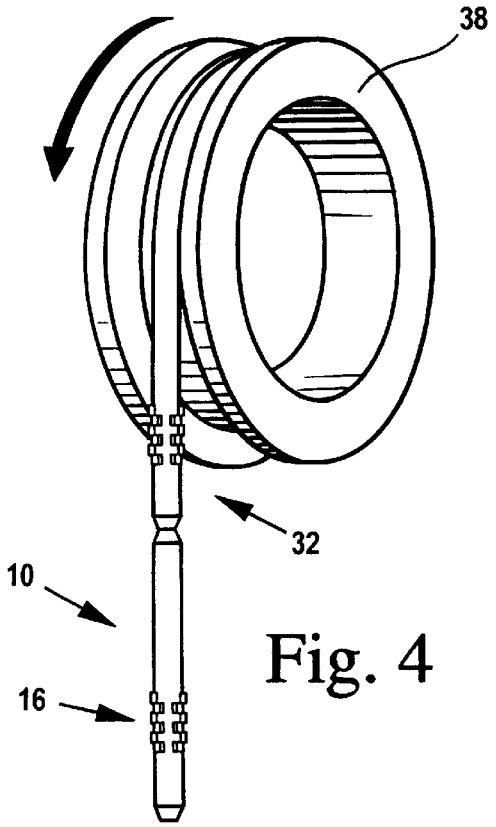
FIG. 4 is a schematic view of the pin strip of FIG. 2 reeled up on a reel.
Figure 5:
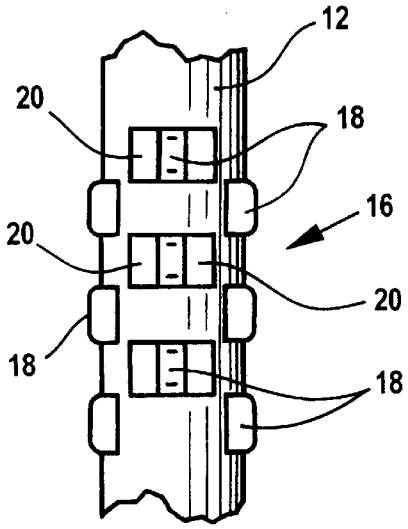
FIG. 5 is an enlarged view of the knurl section of the pin of FIG. 1.

The insertion of the pin is typically carried out by a placement machine, known as an automatic insertion machine, which detaches a pin from a reel 38 (FIG. 4) of the continuously-formed strip of wire and inserts it into the board hole or header, often under computer control. The fitting of the pin 10 in the hole 14 is a press-fit (hereinafter defined), so that the pin will be stably held in position for soldering or further processing when a PCB is involved. Since the set of bumps and grooves are evenly arranged around the perimeter of the knurl section 16, the resultant pattern serves to center the enlarged pin section in the hole of the substrate. To prevent damage to the PCB hole plating if present while allowing pins with a certain range of dimensions to be used, the hole size is preferably kept within certain tolerances, such as ±0.002 inches.

The strip-making process is a continuous wire-forming process generally of the type described in U.S. Pat. No. 4,318,964 in which a continuous length of preplated copper-alloy electrical-pin-forming wire, supplied from a reel, is typically fed through a machine, in turn through a bump-and-groove-punching station and then through a notching station, followed by reeling up of the finished continuous strip of finished pins. Any copper alloy, such as brass can be used in this application. The overall pin lengths can cover a wide range, for example, from 0.25–2 inches.

Figure 9:
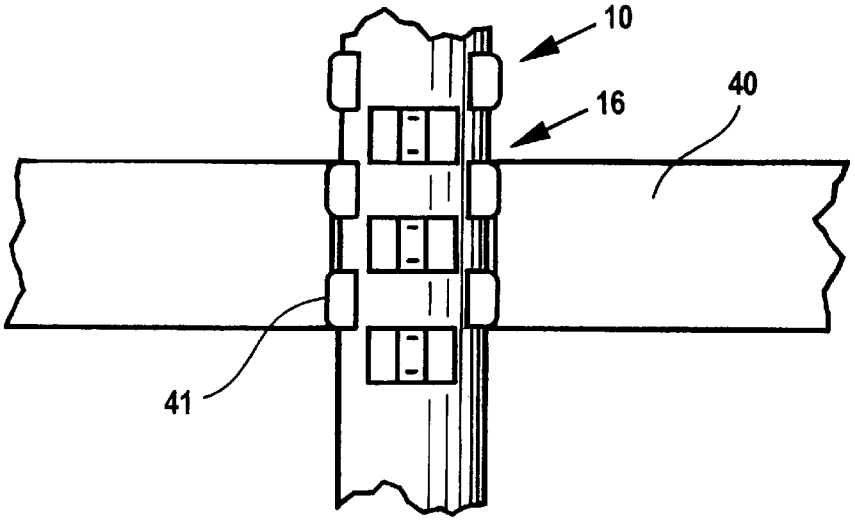
FIG. 9 is a schematic view showing a portion of the pin of FIG. 1 mounted in a substrate.

Press-fitted, as used herein in describing the invention, means a minimum interference between a mating hole and contact member knurl section. For a typical 0.018 inch pin, this minimum interference amounts to about 0.003 inches. The holes that are provided in substrates typically have a nominal dimension with a given positive and negative tolerance. For example, for receiving a standard 0.025 inches press-fit pin, the hole would typically have a nominal dimension of 0.021±0.002 inches. To maintain a desired minimum interference of, say, 0.003 inches, the widest dimension across the knurl section would be 0.027±0.001 inches. The acceptable interference depends on the material forming the hole. Elastically deformable material, such as the plastics commonly used in headers, could support larger interferences than the pressed material commonly used for PCBs. FIG. 9 illustrates a substrate portion 40 having a hole 41 with a pin 10 of the type shown in FIG. 1 inserted in the hole. The spaced bumps embed themselves in the plastic at the hole sides, and plastic at the hole sides will flow into the grooves, providing greater retention compared with the known pin constructions.

In addition to the advantages set forth above, the inserted pins may or may not be soldered depending on the mechanical, environmental, and electrical performance requirements of the application. Moreover, they may be inserted in the PCB hole, removed before soldering, and re-used several times without damage to the hole or to the pin.

The process of the invention provides a continuously formed press fit surface, which creates a scrapless package, to permit automatic feeding of the component and/or assembly, with the following features. A series of bumps and grooves on the surface which when pressed into a substrate provides low stress grooves which improves pin retention. A scrapless proscess of producing continuously formed parts for ease of automation (no carrier strip or secondary packaging required). A method of producing a knurl-like area in a continuous stamping process, on a round, square or rectangular pin, with minimal axial pin growth. A press-fit area which improves product reliability by reducing abrasion or hole damage during insertion of the pin. A press-fit area which protects the engagement area of the pin from being damaged due to scraping off of the plating during assembly. A pin construction that provides good retention without sacrificing pin strength, especially for miniature pins.

The knurled section construction also provides the important benefit of allowing the manufacture as described of a series of the contact members by a wire-forming process providing reeled end-to-end, notched, continuous contact members ready for insertion by conventional insertion machines into substrates as desired, typically realized by separating the lead pin at a notch 30 from the continuous strip during the insertion process. The notching also conveniently forms the bevel ends 14 at opposite ends of the one-piece contact member.

The invention is of particular importance for pins or sockets which have a press fit knurled section and where the widest dimension of the pin is approximately 0.062 inches square or less as the skiving in accordance with the invention of relatively small chunks of metal does not reduce the cross section of the pin or socket as much as does the manufacture of the standard star, which typically involves the displacement of relatively larger chunks of metal. As a result, a pin or socket with the knurl section of the invention has a larger cross section at the knurl which allows the pin or socket to be stiffer and less likely to be bent during installation or use. This feature is important in high density applications where pin straightness is critical.

The examples given for the nominally sized pins apply to both round and square or rectangular pins, and the annexed claims should be understood in the same light.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A pin or socket member for insertion into a hole in a substrate, comprising:

a) an elongated cylindrical or rectangular body having a longitudinal axis and a knurl section providing an enlarged diameter section for press-fitting into the hole, b) said knurl section being characterized by an axially-extending section whose length is substantially shorter than that of the elongated body and comprising at least first and second axially-adjacent, axially-spaced sets of opposed bumps and adjacent grooves, said bumps and adjacent grooves being located on the sides of the body when cylindrical and on the sides of the body when rectangular and the corners of the body when rectangular being free of the bumps and adjacent grooves, the first set of opposed bumps and adjacent grooves occupying a first position along the knurl section, the second set of opposed bumps and adjacent grooves occupying a second position along the knurl section, the second position being axially spaced from the first position and being peripherally rotated about 90° with respect to the first position, said opposed bumps extending laterally outwardly from the body and having been formed by skiving of material from the body during formation of the groove, said opposed bumps providing the enlarged diameter section.

2. A pin or socket member according to claim 1, wherein the elongated body is constituted of electrically-conductive material.

3. A pin or socket member according to claim 1, wherein the pin or socket member has a widest dimension, and the widest dimension of the pin or socket member is approximately 0.062 inches or less.

4. A pin or socket member according to claim 1, wherein each bump has at least one raised region extending outwardly from the laterally-outermost surface of the bump.

5. A pin or socket member according to claim 1, wherein the knurl section comprises six axially-spaced sets of bumps and perimetrically-adjacent grooves adjacent opposite sides of each bump.

6. A pin or socket member according to claim 1, wherein the knurl section comprises plural spaced sets of bumps and perimetrically-adjacent grooves adjacent opposite sides of each bump.

7. A pin or socket member according to claim 6, wherein adjacent sets of bumps are axially spaced apart by a distance of at least 0.002 inches.

8. A pin or socket member according to claim 1, wherein each bump has an outer concave region.

9. A pin or socket member according to claim 8, wherein the concave region is flanked by raised regions extending outwardly from the laterally-outermost surface of the bump and having a height of approximately 5–50% of the height of the bump.

10. The combination of a substrate having a hole and a male pin or socket member press-fitted into the hole in the substrate, said hole having a nominal dimension with a given positive and negative tolerance, said pin or socket member comprising:

a) an elongated cylindrical or rectangular body having a longitudinal axis and a knurl section providing an enlarged diameter for press-fitting into the hole, b) said knurl section being characterized by an axially-extending section whose length is substantially shorter than that of the elongated body and comprising at least first and second axially-adjacent, axially-spaced sets of opposed bumps and adjacent grooves, said bumps and adjacent grooves being located on the sides of the body when cylindrical and on the sides of the body when rectangular and the corners of the body when rectangular being free of the bumps and adjacent grooves, the first set of opposed bumps and adjacent grooves occupying a first position along the knurl section, the second set of opposed bumps-and adjacent grooves occupying a second position along the knurl section, the second position being axially spaced from the first position and being peripherally rotated about 90° with respect to the first position, said opposed bumps extending laterally outwardly from the body and being formed by skiving of material from the body during formation of the groove, said bumps providing the enlarged diameter exceeding the nominal hole dimension plus the nominal hole dimension's positive tolerance by at least 0.001 inches.

11. The combination according to claim 10, wherein the pin or socket is made of a copper alloy provided with a solderable surface plating.

12. The combination according to claim 10, wherein the pin or socket member has a widest dimension, and the widest dimension of the pin or socket member is approximately 0.062 inches or less.

* * * * *